US006568463B1

(12) United States Patent
Holzgruber et al.

(10) Patent No.: US 6,568,463 B1
(45) Date of Patent: May 27, 2003

(54) METHOD AND DEVICE FOR THE CONTINUOUS PRODUCTION OF ELECTROSLAG-CASTED OR REMELTED BILLETS

(75) Inventors: Harald Holzgruber, Bruck a.d. Mur (AT); Wolfgang Holzgruber, Bruck a.d. Mur (AT); Bertram Ofner, Kapfenberg (AT)

(73) Assignee: Inteco Internationale Technische Beratung Ges.m.b.H., Bruck A.D. Mur (AT)

( * ) Notice: Subject to any disclaimer, the term of this patent is extended or adjusted under 35 U.S.C. 154(b) by 0 days.

(21) Appl. No.: 09/980,141

(22) PCT Filed: May 12, 2000

(86) PCT No.: PCT/EP00/04290

§ 371 (c)(1),
(2), (4) Date: Nov. 29, 2001

(87) PCT Pub. No.: WO00/75386

PCT Pub. Date: Dec. 14, 2000

(30) Foreign Application Priority Data

Jun. 8, 1999 (AI) ..... 1009/99

(51) Int. Cl.[7] ..... B22D 11/128; B22D 27/02
(52) U.S. Cl. ..... 164/484; 164/497; 164/470
(58) Field of Search ..... 164/484, 497, 164/470, 441, 442, 508, 509

(56) References Cited

U.S. PATENT DOCUMENTS

| | | | | |
|---|---|---|---|---|
| 3,752,216 A | * | 8/1973 | Fritsche | 164/509 |
| 4,108,237 A | * | 8/1978 | Brovman et al. | 164/425 |
| 5,799,721 A | * | 9/1998 | Holzgruber et al. | 164/470 |

FOREIGN PATENT DOCUMENTS

| | | | |
|---|---|---|---|
| AT | 399 463 | | 3/1987 |
| EP | 0 635 324 | | 1/1995 |
| JP | 63-072840 | * | 4/1988 |

* cited by examiner

*Primary Examiner*—Tom Dunn
*Assistant Examiner*—I.-H. Lin

(57) ABSTRACT

The invention relates to a method and the apparatus required for carrying out the method for the continuous production of billets or ingots of metals, in particular steels and Ni- and Co-base alloys using the method of electroslag remelting and electroslag continuous casting in downwardly open water-cooled ingot molds, in which the billet issuing downwardly from the ingot mold is pressed against at least one guide element arranged rigidly in respect of its position with respect to the ingot mold axis, by at least one clamping element arranged opposite the guide element, in such a way that the regions of the billet surface which are in contact with the guide or clamping elements change within short intervals of time, wherein at least one of the elements is driven to withdraw the billet while the others move with the billet and a contact with a current source can be made by way of at least one of the elements.

5 Claims, 1 Drawing Sheet

METHOD AND DEVICE FOR THE CONTINUOUS PRODUCTION OF ELECTROSLAG-CASTED OR REMELTED BILLETS

CROSS-REFERENCE TO RELATED APPLICATION

This application is a 371 of PCT/EP00/04290 filed on May 12, 2000.

BACKGROUND OF THE INVENTION

The invention concerns a method for the continuous production of a billet or ingot of metal and an apparatus which is suitable for same.

The continuous production of blooms or billets using the method of electroslag remelting or electroslag casting is basically known.

Such a method with apparatus is to be found in JP-A-63 072 840; disposed beneath the ingot-mold on both sides of the path of movement of the billet in mutually opposite relationship are clamping members, which are movable radially relative to the axis of the billet relative thereto, of clamping devices which are connected to the current source of the ingot mold. The billet is drawn off downwardly-with those clamping members.

Sh. Sasayama et al describe a method for the continuous remelting of self-consumable electrodes using the electroslag remelting method in a water-cooled ingot mold with continuous billet withdrawal by a draw-off apparatus.

Continuous production of remelted billets is made possible by use of the electrode change technology and cutting of the billets produced of small dimensions in the installation, in which respect the remelting rates for casting cross-sections of 130–250 $mm^2$ are specified at 180–275 kg/h and thus range in the area of 1.1–1.38 kg/h/mm billet thickness.

A. E. Vokov et al describe a continuous method for melting grinding dust in a slag bath heated by a non-consumable electrode in a water-cooled ingot mold with continuous billet withdrawal by a so-called bloom, clamping and draw-off apparatus. An autogenous cutting apparatus arranged in the installation permits the remelted billets produced to be cut to length. The remelting rates are specified at 210–240 kg/h for billets of a 300 mm diameter and are accordingly 0.7–0.8 kg/h/mm billet diameter.

AT 399 463 B discloses a method of electroslag continuous casting of steels and alloys, in which the casting surface in the water-cooled ingot mold is covered by an electrically conductive slag and in which the slag bath is heated for example when current passes therethrough by auxiliary electrodes which dip thereinto. In that method the casting speed is said to be so set that it is at least 1.5 times the melting-away rate which is usual in an electroslag remelting procedure and at most 50% of the casting speed in the case of conventional continuous casting. There is no information about the way in which the billet is withdrawn.

U.S. Pat. No. 5,799,721 discloses a method of electroslag billet melting of metals, in which self-consumable electrodes whose cross-sectional area is 0.5 times the cross-sectional area of the remelting billet are remelted at-a melting-away rate in kg/h, which corresponds to between 1.5 and 30 times the equivalent billet diameter calculated from the periphery of the casting cross-section, in accordance with $D_{eq}=U/\pi$ in mm. There is also no information about the way in which the billet is drawn off.

On the other hand, very different arrangements are known for continuously drawing off the billets, for the continuous casting of steels and alloys, in which respect those apparatuses are always arranged at a considerable spacing from the water-cooled ingot mold and a secondary cooling section is generally disposed between the water-cooled ingot mold and the billet draw-off apparatus.

In the case of so-called arc installations the billet draw-off apparatus also has to perform the function of a continuously operating bending and straightening installation.

Draw-off apparatuses for continuously operating electroslag installations however must additionally also be in a position to carry away either all or at least a part of the melting current from the billet produced, without any interruption, in which respect consideration is to be paid to guiding the billet which is being drawn off, at a small spacing from the lower edge of the ingot mold.

Contact with a current source can basically be made with the clamping apparatuses referred to in the literature.

Both roller elements and also movable clamping jaw systems are known for the purposes of drawing off the billet. Roller elements enjoy the advantage that, when the billet is moving, the contact locations with the surface of the billet continuously change so that inadmissible cooling of the surface of the billet is avoided, even when using water-cooled rollers. On the other hand, taking off the melting current by way of rollers is admittedly possible by using brushes, but it is not entirely simple to implement that when higher current strengths are involved.

In contrast, in regard to taking off the current, clamping jaws with a relatively short stroke movement enjoy advantages as a fixed current-conducting connection is comparatively simple to make by using flexible. line elements such as cables or bands. On the other hand clamping jaws which move with the billet in the draw-off movement thereof are in constant contact with the surface of the billet during the clamping phase so that, in a long clamping phase, unacceptable cooling of the surface of the billet can be caused at the contact locations. For that reason, the engagement times of clamping jaw elements may not be selected to be too long, in which respect it can be helpful, similarly as in the case of forging tools, to allow a certain rise in temperature of the clamping jaw contact surface.

SUMMARY OF THE INVENTION

In consideration of that state of the art the inventor set himself the aim of simplifying the known methods and apparatuses, avoiding the disadvantages noted.

In the method according to the invention, the billet issuing from the ingot mold is pressed against at least one guide element which is arranged rigidly in respect of its arrangement with respect to the ingot mold axis and which is in the form of roller elements comprising one or more rollers by at least one clamping element which is arranged in opposite relationship thereto in such a way that the contact points of the surface of the billet and the guide or clamping element continuously change, wherein at least one of those elements is driven for the purposes of drawing off the billet while the other moves with the movement of the billet and contact with a current source can be made at least by one of said elements.

It has proven to be desirable for the billet issuing from the ingot mold to be pressed against one or more rollers, the axes of which are arranged at 90° relative to the axis of the billet. In addition, the billet is to be drawn off by at least one roller against which the billet is pressed being driven.

The melting current is advantageously taken off by way of the clamping jaws which can be alternately pressed against the billet, in which respect the pressing times of the individual jaws do not exceed two minutes.

In order to keep short the contact times of the clamping jaws with the surface of the billet, the clamping jaws can preferably also be in the form of swing or rocking jaws which, similarly to a roller of large radius, roll along the surface of the billet during the clamping cycle.

The billet draw-off movement can be effected by one or more driven rollers or also by at least two clamping jaws of which one is always pressed against the billet and at the same time the draw-off movement is produced by a suitable device, while the second jaw is withdrawn and is returned to its upper position, in relation to the billet draw-off movement.

In that situation, the rollers which are not driven or the clamping jaws which are pressed against the billet also move with the draw-off movement of the billet, in which case the non-driven roller can be in the form of a measuring roller.

An apparatus suitable for carrying out the method according to the invention comprises a rigid frame which is aligned in relation to the axis of the ingot mold and which has at least two water-cooled guide rollers of which at least one is driven, and at least two clamping jaws which are connected to a current source and which can be pressed against the surface of the billet.

BRIEF DESCRIPTION OF THE DRAWINGS

Further advantages, features and details of the invention will be apparent from the description hereinafter of a preferred embodiment and with reference to the drawing in which the single Figure is a diagrammatic view in longitudinal section through an apparatus according to the invention.

DETAILED DESCRIPTION OF THE PREFERRED EMBODIMENT(S)

Figure 1:
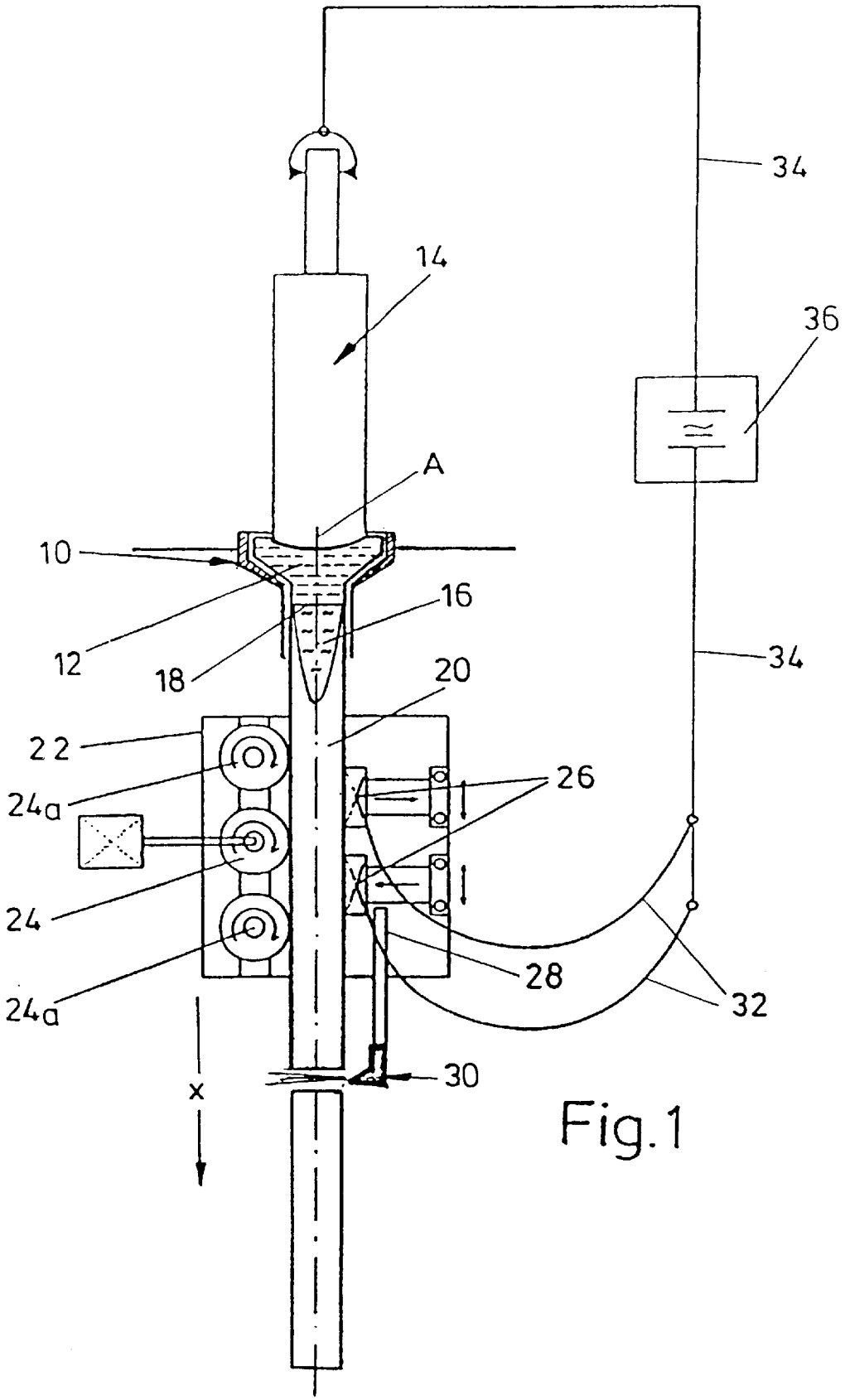

Disposed in a water-cooled ingot mold 10 which can also be in the form of a per se known funnel ingot mold is a slag bath 12 in which a self-consumable electrode 14 is being melted down. The melted-down metal is collected in a melting sump 16; the surface of the molten metal therein is identified by reference 18.

A billet 20 which is formed after setting a drawn off downwardly from the ingot mold 10 in the direction x by a driven roller 24 which is arranged in a rigid frame 22, in relation to the axis A of the ingot mold. Guidance for the billet 20 in parallel relationship to the axis A of the ingot mold is afforded by the above-mentioned driven roller 24 and further rollers $\mathbf{24}_a$, against which the billet 20 is pressed alternately by one of two clamping means 26 which are displaceable in a vertical direction.

A holding device 28 for the lower one of the two clamping means 26 carries an autogenous flame cutting device 30 with which the billet 20 produced can be cut to length in the phase of engagement of the clamping means 26. The clamping means 26 are connected to a current source 36 by way of flexible cables 32 and high-power lines 34.

In a particularly advantageous embodiment the jaws of the clamping means 26, which jaws are pressed alternately against the billet, are in the form of swing or rocking clamping jaws, the axes of which are arranged in the rigid frame 22 in such a way that the clamping means 26 are movable.

What is claimed is:

1. A method for continuous producing a billet or ingot of metal by electroslag remelting or electroslag continuous casting in a downwardly open ingot mold from which a downwardly issuing billet is drawn from the ingot mold by at least one clamping device which is in contact with a current source, said method comprising the steps of:

pressing a region of a surface of the billet outside the ingot mold against at least one guide element which is arranged rigidly with respect to an axis of the billet and pressing on opposite region of an opposite surface of the billet by at least one clamping element arranged in opposite relationship thereto in such a way that the regions which are in contact with the at least one guide element and the at least one clamping element change in short intervals of time, drawing off the billet using a driven guide roller which forms the at least one guide element and which extends transversely with respect to the axis of the billet and whose axis is arranged at an angle of 90° relative to the axis of the billet and displacing the at least one clamping element in a draw-off direction.

2. A method as set forth in claim 1, further comprising: providing two clamping elements, each of said clamping elements being movable with said billet; alternately pressing at least one of the clamping elements against the billet while said billet is pressed against said at least one guide element; withdrawing one of said clamping elements during draw-off movement of the billet; and moving said withdrawn clamping element in a direction opposite to the draw-off of said billet to an upper position where said withdrawn clamping element is positioned to re-engage said billet.

3. A method as set forth in claim 1, further comprising rolling the at least one guide element along the surface of the billet.

4. A method as set forth in claim 1, further comprising contacting the at least one clamping element with the surface of the billet for at most two minutes.

5. A method as set forth in claim 1, further comprising effecting an electrode change for a fully continuous mode of operation.

* * * * *